US007331772B2

(12) United States Patent
Jung et al.

(10) Patent No.: US 7,331,772 B2
(45) Date of Patent: Feb. 19, 2008

(54) COMPRESSOR

(75) Inventors: Choong-Min Jung, Gyeonggi-Do (KR); Kwang-Ha Suh, Gyeonggi-Do (KR); Ki-Won Noh, Seoul (KR); Yong-Hwan Eom, Seoul (KR)

(73) Assignee: LG Electronics Inc., Seoul (KR)

( * ) Notice: Subject to any disclaimer, the term of this patent is extended or adjusted under 35 U.S.C. 154(b) by 623 days.

(21) Appl. No.: 10/891,085

(22) Filed: Jul. 15, 2004

(65) Prior Publication Data

US 2005/0142008 A1 Jun. 30, 2005

(30) Foreign Application Priority Data

Dec. 30, 2003 (KR) ..... 10-2003-0100723

(51) Int. Cl.
*F04B 35/04* (2006.01)

(52) U.S. Cl. ..... 417/417

(58) Field of Classification Search ..... 417/417; 310/15

See application file for complete search history.

(56) References Cited

U.S. PATENT DOCUMENTS 3,788,778 A * 1/1974 Miller ..... 417/417
6,435,842 B2 * 8/2002 Song ..... 417/417
6,733,245 B2 * 5/2004 Oh et al. ..... 417/417
6,793,470 B2 9/2004 Song et al.
2005/0142014 A1 6/2005 Jung et al.

FOREIGN PATENT DOCUMENTS

| | | |
|---|---|---|
| CN | 1432107 | 7/2003 |
| KR | 1989-13529 | 8/1989 |
| KR | 2004-17958 | 3/2004 |

OTHER PUBLICATIONS

English language Abstract of Korea 1989-13529.
English language Abstract of Korea 2004-17958.

* cited by examiner

*Primary Examiner*—Michael Koczo, Jr.
(74) *Attorney, Agent, or Firm*—Greenblum & Bernstein, P.L.C.

(57) ABSTRACT

A compressor comprises a reciprocating motor disposed within a casing, for generating a driving force; a compressing unit for sucking, compressing and discharging gas by a linearly reciprocating motion of a piston connected to the reciprocating motor; a plurality of resonant springs connected to the piston, for inducing a resonant motion to the linearly reciprocating motion of the piston, wherein centers of the resonant springs are positioned at the same radius on the basis of a central axis of the piston.

13 Claims, 7 Drawing Sheets

COMPRESSOR

BACKGROUND OF THE INVENTION

1. Field of the Invention

The present invention relates to a compressor, and more particularly, to a compressor capable of enhancing a capability and a reliability by preventing an eccentric motion of a piston.

2. Description of the Conventional Art

Generally, a compressor is an apparatus for sucking, compressing, and discharging gas while a piston is reciprocated in a cylinder.

As shown in FIG. 1, the conventional compressor comprises: a casing 10 to which a suction pipe 12 for sucking gas and a discharge pipe 14 for discharging compressed gas are respectively connected; a reciprocating motor 30 disposed in the casing 10, for generating a driving force; a compressing unit 40 for sucking, compressing, and discharging gas by a driving force of the reciprocating motor 30; a resonant spring unit 50 for inducing a resonance motion to a reciprocating motion of the reciprocating motor 30; and a frame unit 20 for respectively supporting the reciprocating motor 30, the compressing unit 40 and the resonant spring unit 50.

The reciprocating motor 30 includes: an outer stator 31; an inner stator 32 disposed to maintain a certain air gap with an inner circumference of the outer stator 31; a magnet 34 disposed between the outer stator 31 and the inner stator 32; and a magnet holder 33 connected to the magnet 34 and reciprocated by an electromagnetic interaction between the outer/inner stators 31/32 and the magnet 34.

The compressing unit 40 includes: a cylinder 41 having an inner space therein; a piston 42 disposed in the cylinder 41, having a gas suction path F therein, and reciprocated by being connected to the magnet holder 33 of the reciprocating motor 30, for varying a volume of a compressing space P inside the cylinder 41; a suction valve 43 mounted at a front side of the piston 42 and operated by a pressure inside the compressing space P, for opening and closing a gas inlet; a discharge valve 44 installed at a front side of the cylinder 41 for opening and closing a gas outlet; a valve spring 45 for elastically supporting the discharge valve 44; and a discharge cover 46 communicated to the discharge pipe 14 through a guiding pipe 16 and accommodating the discharge valve 44 and the valve spring 45.

The frame unit 20 includes: a first frame 21 mounted at a front side of the reciprocating motor 30 and the cylinder 41; a second frame 22 connected to the first frame 21, for supporting the reciprocating motor 30 with the first frame 21; and a third frame 23 connected to the second frame 22, for supporting the resonant spring unit 50 with the second frame 22.

The resonant spring unit 50 includes: a spring seat 53 disposed between the second frame 22 and the third frame 23 and reciprocated by being connected to the piston 42; a first resonant spring 51 disposed between the second frame 22 and the spring seat 53, and shrunk when the piston 42 forwardly moves and extended when the piston 42 backwardly moves; and a second resonant spring 52 disposed between the third frame 23 and the spring seat 53, and extended when the piston 42 forwardly moves and shrunk when the piston 42 backwardly moves.

As shown in FIG. 2, the second frame 22 is formed as a disc shape, and is provided with a spring fixing protrusion 22*a* to which the first resonant spring 51 is fixed. The third frame 23 is formed as a curved plate shape so that a space for accommodating the spring seat 53 is provided, and is provided with a spring fixing protrusion 23*a* for fixing the second resonant spring 52. Also, a flange portion 23*b* having a predetermined width L is formed at both ends of the third frame 23*b*. The flange portion 23*b* is coupled to the second frame 22 by a bolt B or a welding method, thereby fixing the third frame 23 to the second frame 22.

The spring seat 53 includes: a connection portion 70 formed as a disc shape and connected to one end of the magnet holder 33 or the piston 42; a pair of first supporting portions 80 respectively and radially extended from the connection portion 70 to have a phase difference of 180° each other, and respectively provided with a first protrusion 82 for fixing the first resonant spring 51; and a pair of second supporting portion 90 respectively and radially extended from the connection portion 70 to have a phase difference of 90° with the first supporting portions 80, and respectively provided with a second protrusion 92 for fixing the second resonant spring 52.

The first resonant spring 51 is respectively fixed to the spring fixing protrusion 22*a* of the second frame 22 and the first protrusion 82 of the first supporting portion 80 of the spring seat 53, and the second resonant spring 52 is respectively fixed to the resonant spring fixing protrusion 23*a* of the third frame 23 and the second protrusion 92 of the second supporting portion 90 of the spring seat 53.

As shown in FIG. 3, a distance d1 from the center of the spring seat 53 to the center of the first protrusion 82 of the first supporting portion 80 is greater than a distance d2 from the center of the spring seat 53 to the center of the second protrusion 92 of the second supporting portion 90. That is, the radius d1 of a circle connecting each center of a pair of the first resonant springs 51 is greater than the radius d2 of a circle connecting each center of a pair of the second resonant springs 52.

According to this, loads of the first and second resonant springs 51 and 52 applied to the spring seat 53 are not uniformly applied to a circumferential direction of the spring seat 53, but are eccentrically applied. By these eccentric loads, the spring seat 53 performs an undesired rotational motion at the time of a linear reciprocation thereof. According to this, the piston 42 connected to the spring seat 53 and the magnet holder 33 performs unstable motions, a vibration is generated, and an abrasion due to a friction between the piston 42 and the cylinder 41 may occur, thereby lowering a capability of the compressor.

SUMMARY OF THE INVENTION

Therefore, an object of the present invention is to provide a compressor capable of enhancing a capability thereof by installing a plurality of resonant springs for inducing a resonant motion to a linear reciprocation of a piston so that the centers of the resonant springs are positioned on the same circumference.

To achieve these and other advantages and in accordance with the purpose of the present invention, as embodied and broadly described herein, there is provided a compressor comprising: a reciprocating motor disposed within a casing, for generating a driving force; a compressing unit for sucking, compressing and discharging gas by a linearly reciprocating motion of a piston connected to the reciprocating motor; and a plurality of resonant spring connected to the piston, for inducing a resonant motion to the linearly reciprocating motion of the piston, wherein centers of the resonant springs are positioned at the same radius on the basis of a central axis of the piston.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, preferred embodiments of the present invention will be explained.

Figure 1:
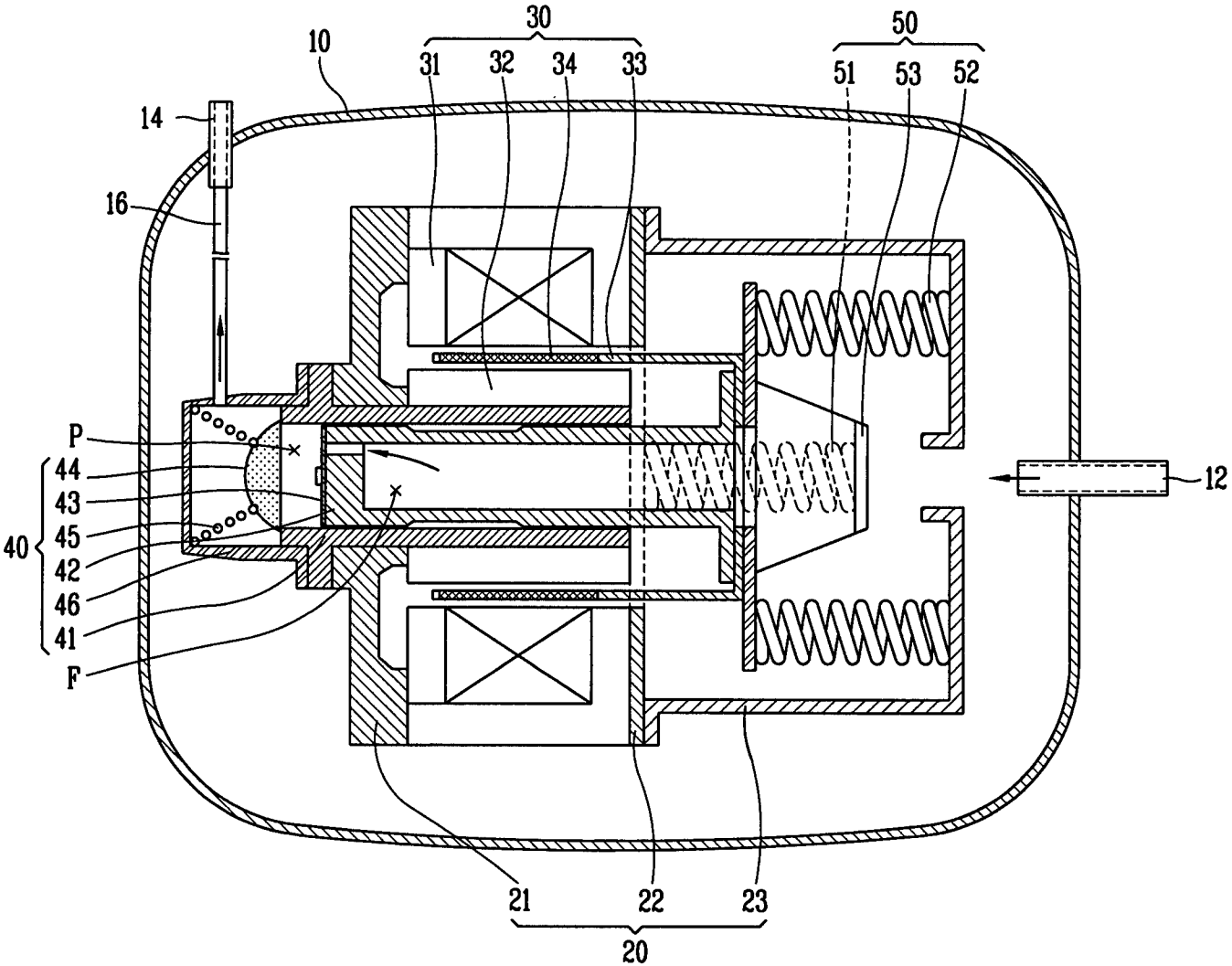
FIG. 1 CONVENTIONAL ART
FIG. 1 is a sectional view showing a compressor in accordance with the conventional art.
Figure 2:
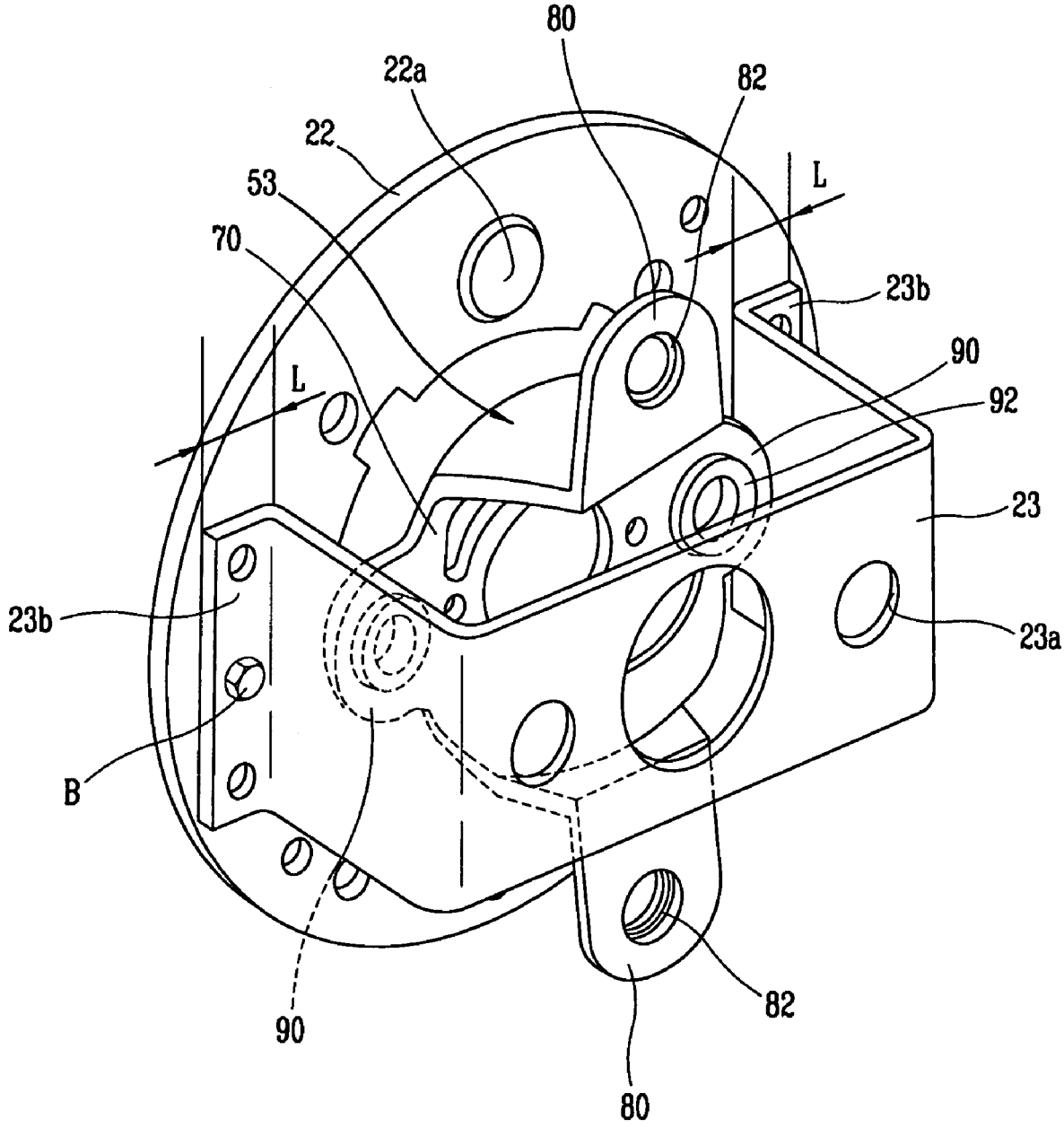
FIG. 2 CONVENTIONAL ART
FIG. 2 is a perspective view showing a resonant spring supporting structure provided at the compressor in accordance with the conventional art.
Figure 3:
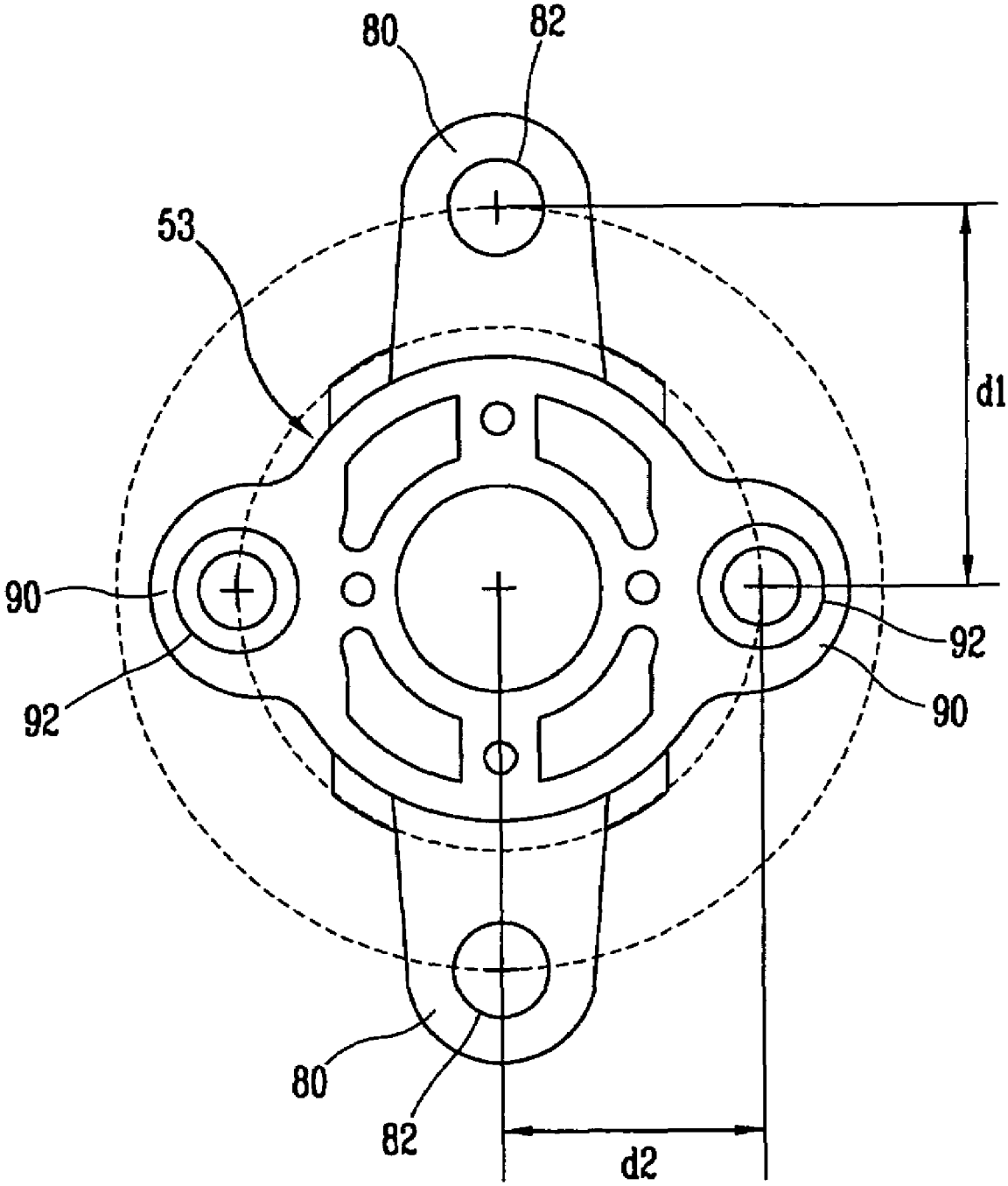
FIG. 3 CONVENTIONAL ART
FIG. 3 is a plan view showing the resonant spring supporting structure provided at the compressor in accordance with the conventional art.
Figure 4:
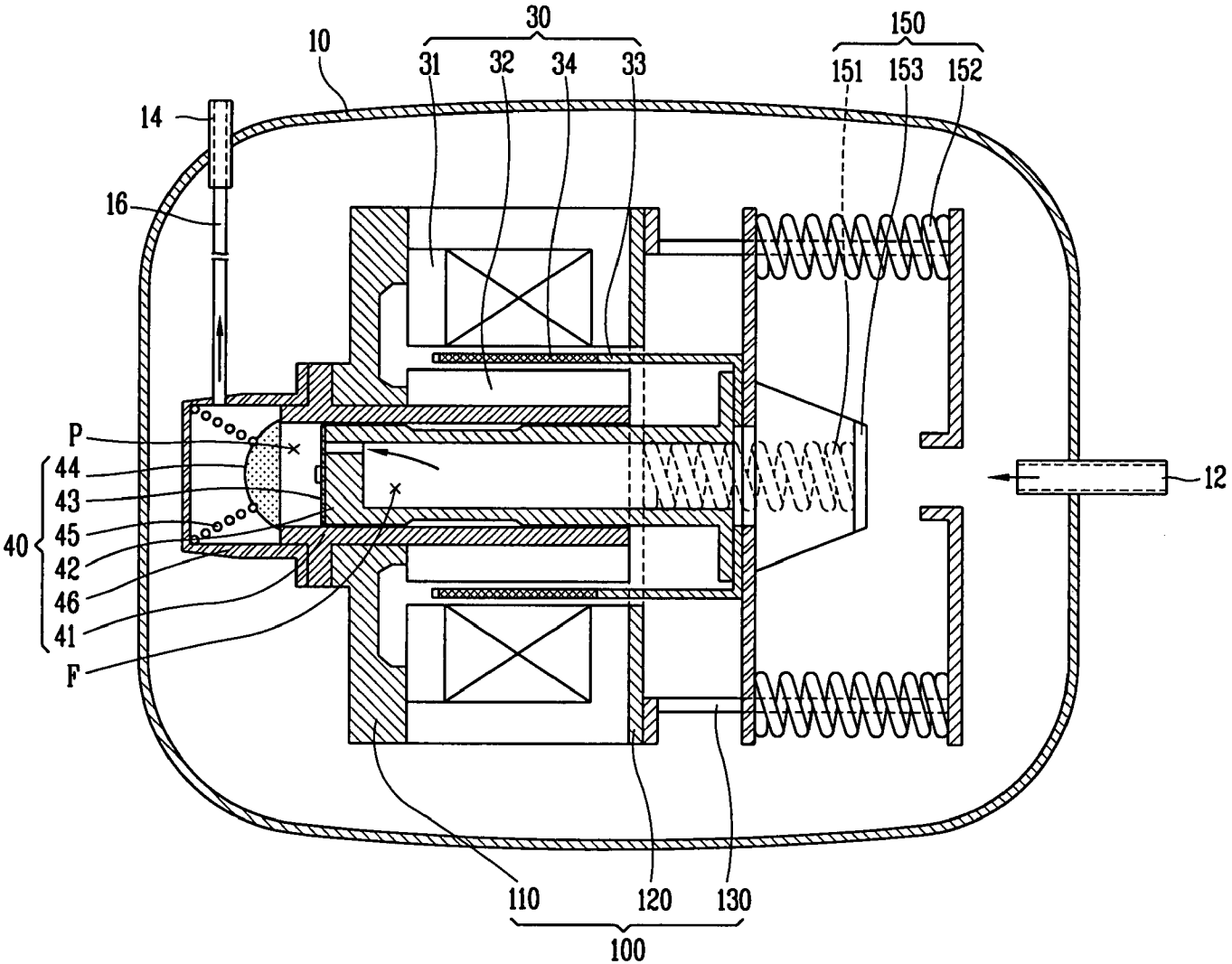
FIG. 4 is a sectional view showing a compressor according to the present invention.

As shown in FIG. 4, a compressor according to one embodiment of the present invention comprises: a casing 10 to which a suction pipe 12 for sucking gas and a discharge pipe 14 for discharging compressed gas are respectively connected; a reciprocating motor 30 disposed in the casing 10, for generating a driving force; a compressing unit 40 for sucking, compressing and discharging gas by a driving force of the reciprocating motor 30; a resonant spring unit 150 for inducing a resonance motion to a reciprocating motion of the reciprocating motor 30; and a frame unit 100 for respectively supporting the reciprocating motor 30, the compressing unit 40 and the resonant spring unit 150.

The reciprocating motor 30 includes: an outer stator 31; an inner stator 32 disposed to maintain a certain air gap with an inner circumference of the outer stator 31; a magnet 34 disposed between the outer stator 31 and the inner stator 32; and a magnet holder 33 connected to the magnet 34 and reciprocated by an electromagnetic interaction between the outer/inner stators 31/32 and the magnet 34.

The compressing unit 40 includes: a cylinder 41 having an inner space therein; a piston 42 disposed in the cylinder 41, having a gas suction path F therein, and reciprocated by being connected to the magnet holder 33 of the reciprocating motor 30, for varying a volume of a compressing space P inside the cylinder 41; a suction valve 43 mounted at a front side of the piston 42 and operated by a pressure inside the compressing space P, for opening and closing a gas inlet; a discharge valve 44 installed at a front side of the cylinder 41, for opening and closing a gas outlet; a valve spring 45 for elastically supporting the discharge valve 44; and a discharge cover 46 communicated to the discharge pipe 14 through a guiding pipe 16 and accommodating the discharge valve 44 and the valve spring 45.

The frame unit 100 includes: a first frame 110 mounted at a front side of the reciprocating motor 30 and the cylinder 41; a second frame 120 connected to the first frame 110, for supporting the reciprocating motor 30 with the first frame 110; and a third frame 130 connected to the second frame 120, for supporting the resonant spring unit 150 with the second frame 120.

The resonant spring unit 150 includes: a spring seat 153 disposed between the second frame 120 and the third frame 130 and reciprocated by being connected to the piston 42; a first resonant spring 151 disposed between the second frame 120 and the spring seat 153, and shrunk when the piston 42 forwardly moves and extended when the piston 42 backwardly moves; and a second resonant spring 152 disposed between the third frame 130 and the spring seat 153, and extended when the piston 42 forwardly moves and shrunk when the piston 42 backwardly moves.

Figure 5:
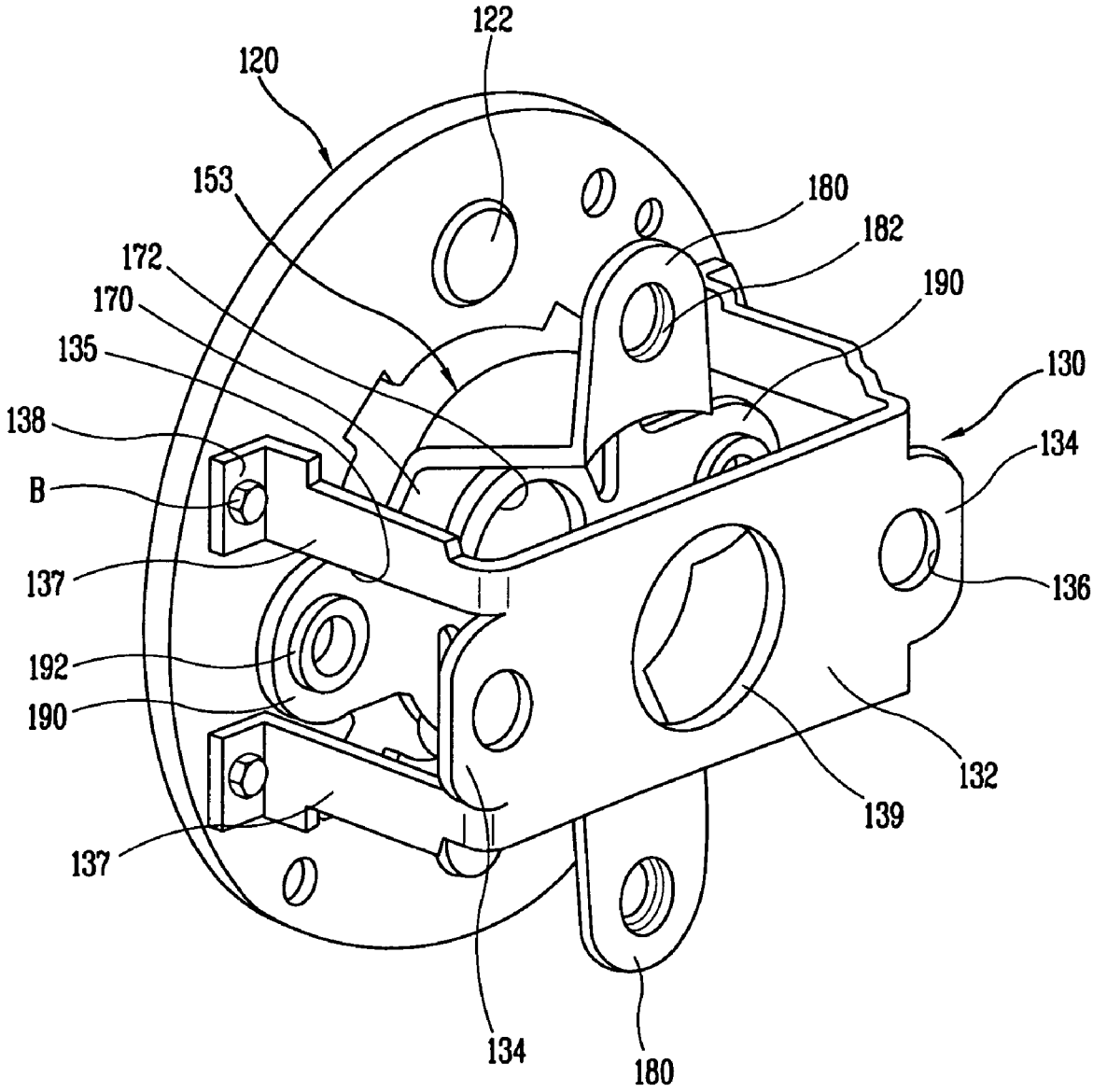
FIG. 5 is a perspective view showing a resonant spring supporting structure provided at the compressor according to the present invention.

As shown in FIG. 5, the spring seat 153 is formed as a disc shape and is provided with a hole 172 for passing suction gas at the center thereof.

As shown in FIG. 5, the spring seat 153 includes: a connection portion 170 formed as a disc shape, provided with a hole 172 at the center thereof through which gas passes, and connected to one end of the magnet holder 33 or the piston; a pair of first supporting portions 180 respectively and radially extended from the connection portion 170 to have a phase difference of 180° each other, and respectively provided with a first protrusion 182 for fixing the first resonant spring 151; and a pair of second supporting portions 190 respectively and radially extended from the connection portion 170 to have a phase difference of 90° with the first supporting portions 180, and respectively provided with a second protrusion 192 for fixing the second resonant spring 152.

The first and second supporting portions 180 and 190 may be formed more than two. In this case, the first and second supporting portions 180 and 190 are preferably arranged with the same interval in view of plan projection. Also, the first and second supporting portions 180 and 190 are preferably arranged to be alternating each other.

The second frame 120 is formed as a disc shape, and is provided with a spring fixing protrusion 122 for fixing the first resonant spring 151. The third frame 130 is arranged to be spaced from the second frame 120 with a certain distance so as to provide a space for the spring seat 153. The third frame 130 includes: a rectangular body portion 132 provided with a hole 139 for passing suction gas at the center thereof; a plurality of leg portions 137 extended from both ends of the body portion 132 towards the second frame 120 and arranged with a certain interval, for defining openings 135 through which the second supporting portions 190 of the spring seat 153 are penetrated; a flange portion 138 bent from each end of the leg portion 137 thus to be coupled to the second frame 120 by a bolt B or a welding method; and a spring fixing portion 134 extended from both sides of the body portion 132 and respectively provided with a spring fixing protrusion 136 for fixing the second resonant spring 152.

Under said construction, the first resonant spring 151 is respectively fixed to the spring fixing protrusion 122 of the second frame 120 and the first protrusion 182 of the first supporting portion 180 of the spring seat 153, and the second resonant spring 152 is respectively fixed to the spring fixing protrusion 136 of the spring fixing portion 134 of the third frame 130 and the second protrusion 192 of the second supporting portion 190 of the spring seat 153.

Figure 6:
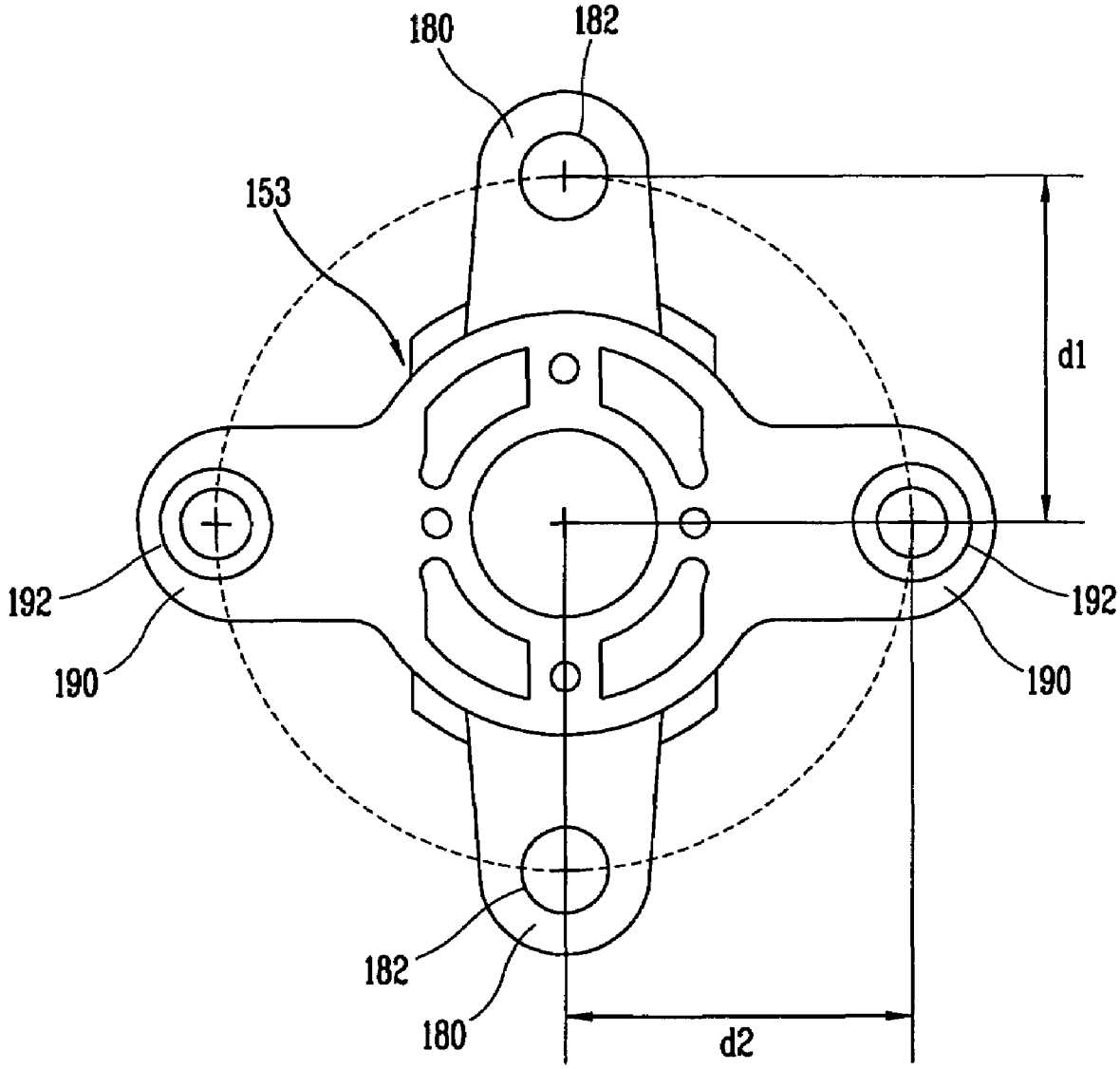
FIG. 6 is a plan view showing the resonant spring supporting structure provided at the compressor according to the present invention.

As shown in FIG. 6, a distance d1 from the center of the spring seat 153 to the center of the first protrusion 182 of the first supporting portion 180 is equal to a distance d2 from the center of the spring seat 153 to the center of the second protrusion 192 of the second supporting portion 190. According to this, centers of the first and second resonant springs 151 and 152 supported at the spring seat 153 are positioned on the same radius on the basis of the central axis of the piston 42.

In order to position each center of the first and second resonant springs 151 and 152 on the same radius from the central axis of the piston 42, the center of the spring fixing protrusion 122 of the second frame 120 and the center of the spring fixing protrusion 136 of the third frame 123 are positioned on the same radius on the basis of the central axis of the piston 42.

Since the first and second resonant springs 151 and 152 have the same support radius, a resonant spring load is uniformly applied to the spring seat 153 and the piston 42 is stably operated at the time of the compressor operation.

Hereinafter, operation and effect of the compressor according to one embodiment of the present invention will be explained. When a power is applied to the outer stator 31 of the reciprocating motor 30, the magnet holder 33 is linearly reciprocated by an electromagnetic interaction between the outer/inner stators 31/32 and the magnet 34. According to this, the piston 42 connected to the magnet holder 33 is linearly reciprocated inside the cylinder 41 thus to vary a volume of the compressing space P. By the volume change of the compressing space P, gas is sucked into the compressing space P, compressed, and discharged, which is repeated. Also, since a resonance motion is induced to the piston 42 by the second/third frames 120/130 and the first/second resonant springs 151/152 supported at the spring seat 153, the linear reciprocation of the piston 42 is smoothly and continuously performed. Herein, since the centers of the first and second resonant springs 151 and 152 are arranged on the same circle, a uniform load is applied to the spring seat 153. Therefore, the piston 42 and the magnet holder 33 are not eccentrically moved or rotated, but are stably reciprocated.

Figure 7:
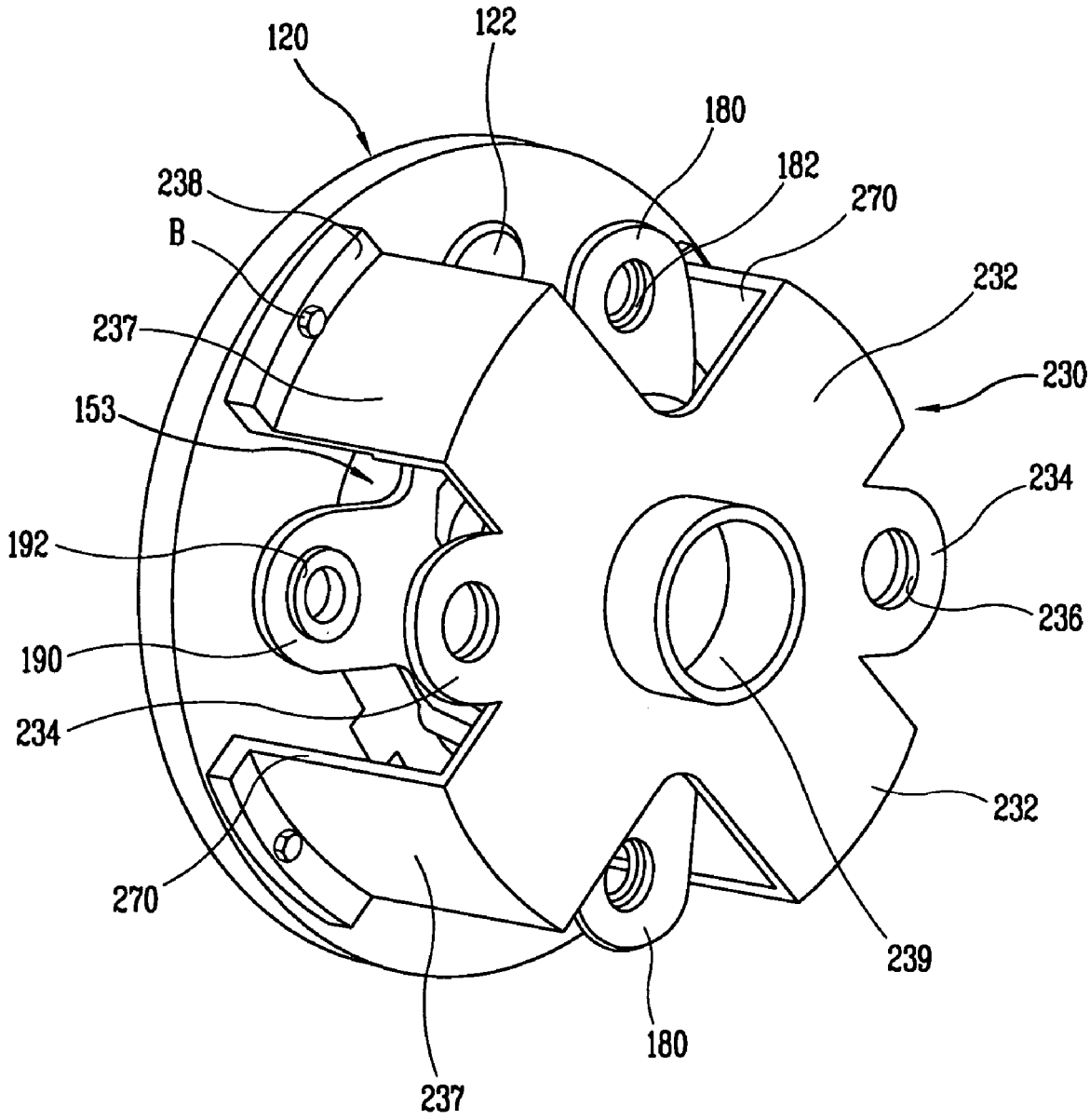
FIG. 7 is a perspective view showing the resonant spring supporting structure provided at the compressor according to another embodiment of the present invention.

Referring to FIG. 7, the compressor according to another embodiment for the present invention will be explained. Hereinafter, the same reference numerals were given to the same components as those of the first embodiment, thereby omitting explanations.

In the compressor according to another embodiment of the present invention, the third frame 230 is formed as a cylindrical shape that provides a space for the spring seat 153 with the second frame 120. That is, the third frame 230 is arranged to be spaced from the second frame 120 with a certain distance, and includes: a body portion 232 of a cross plate shape provided with a hole 239 for passing suction gas at the center thereof; a plurality of leg portions 237 extended from the body portion 232 towards the second frame 220 for defining openings 270 through which the first and second supporting portions 180 and 190 of the spring seat 153 are penetrated; a flange portion 238 bent from each end of the leg portion 237 thus to be coupled to the second frame 120 by a bolt B or a welding method; and a resonant spring fixing portion 234 extended towards right and left sides of the body portion 232 and respectively provided with a spring fixing protrusion 236 for fixing the second resonant spring 152.

A width between the legs 237, that is, a width between the openings 270 is preferably wider than each width of the first and second supporting portions 180 and 190 so that the first and second supporting portions 180 and 190 of the spring seat 153 can be moved back and forth. Also, the leg portions 237 and the flange portion 238 are arranged with a certain interval in a circumferential direction of the second frame 120.

In the compressor according to another embodiment of the present invention, since the leg portions 237 and the flange portion 238 of the third frame 230 are arranged with a certain interval in the circumferential direction of the second frame 120, the third frame 230 is stably fixed to the second frame 120. According to this, loads of the first and second resonant springs 151 and 152 are more stably applied to the spring seat 153.

Operation and effect of the compressor according to another embodiment of the present invention are the same as those of the compressor of the aforementioned embodiment.

In the compressor according to the present invention, a plurality of resonant springs for inducing a resonant motion to linearly reciprocating motions of the piston and the magnet holder are arranged so that each center of the resonant springs can be positioned on the same radius on the basis of the central axis of the piston, thereby preventing noise, vibration, and component abrasion and enhancing the function.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A compressor comprising:

a reciprocating motor disposed within a casing, for generating a driving force;

a compressing unit that draws in, compresses and discharges gas by a linear reciprocating motion of a piston connected to the reciprocating motor;

a resonant spring unit that induces a resonant motion to the linearly reciprocating motion of the piston;

a frame unit that includes a first frame mounted at a front side of the reciprocating motor, a second frame supporting the reciprocating motor together with the first frame and a third frame supporting the resonant spring unit together with the second frame, wherein the third frame includes a body portion spaced from the second frame by a plurality of leg portions extending from the body portion towards the second frame, said plurality of leg portions define openings through which a plurality of first and second supporting portions protrude.

2. The compressor of claim 1, the resonant spring unit includes:

a spring seat disposed between the second frame and the third frame, and connected to the piston;

first resonant springs disposed between the second frame and the spring seat, and second resonant springs disposed between the third frame and the spring seat, wherein centers of the first and second resonant springs are positioned at a same distance from a central axis of the piston.

3. The compressor of claim 2, wherein the first and second resonant springs are uniformly spaced.

4. The compressor of claim 3, wherein the first and second resonant springs are arranged with an angular spacing of 90°.

5. The compressor of claim 4, wherein the first and second resonant springs are positioned to be alternating with each other at a constant spacing.

6. The compressor of claim 4, wherein the spring seat includes:

a connection portion connected to the piston;

said plurality of first supporting portions respectively extending from the connection portion in a radial direction to fix the first resonant springs with respect to the second frame; and said plurality of second supporting portions respectively extending from the connection portion in a radial direction to fix the second resonant springs with respect to the third frame.

7. The compressor of claim 6, wherein the third frame further includes:

flange portions extending from each of the plurality of leg portions, wherein the flange portions couple with the second frame.

8. The compressor of claim 7, wherein the plurality of leg portions are uniformly spaced.

9. The compressor of claim 7, wherein a resonant spring fixing portion extends from both sides of the body portion, to fix the second resonant springs with the plurality of second supporting portions of the spring seat.

10. The compressor of claim 6, wherein the plurality of first and second supporting portions include spring fixing protrusions to which the first and second resonant springs are respectively fixed.

11. The compressor of claim 6, wherein the plurality of first and second supporting portions are respectively uniformly spaced.

12. The compressor of claim 11, wherein the plurality of first and second supporting portions are arranged to be alternating with each other.

13. The compressor of claim 12, wherein the plurality of first and second supporting portions are arranged with an angular spacing of 90°.

* * * * *